US005586688A

United States Patent [19]

Johnson et al.

[11] Patent Number: 5,586,688

[45] Date of Patent: Dec. 24, 1996

[54] ELECTRIC PUMP TOY WATER GUN

[75] Inventors: Lonnie G. Johnson, Smyrna; John Applewhite, Atlanta, both of Ga.

[73] Assignee: Johnson Research & Development Company, Inc., Smyrna, Ga.

[21] Appl. No.: 344,875

[22] Filed: Nov. 25, 1994

[51] Int. Cl.[6] ..... A63H 3/18

[52] U.S. Cl. ..... 222/61; 200/82 R; 222/79; 222/175; 222/333; 222/396

[58] Field of Search ..... 222/61, 79, 175, 222/333, 396, 401; 446/405, 473; 200/82 R

[56] References Cited

U.S. PATENT DOCUMENTS

| | | | |
|---|---|---|---|
| D. 78,206 | 4/1929 | Herman . | |
| D. 159,040 | 6/1950 | Bicos | D30/1 |
| D. 191,686 | 10/1961 | Johnson et al. | D62/2 |
| D. 265,221 | 6/1982 | Hardin | D21/147 |
| D. 285,327 | 8/1986 | Yano | D21/147 |
| D. 297,748 | 9/1988 | Marino | D21/147 |
| D. 303,820 | 10/1989 | Wong | D21/147 |
| D. 318,309 | 7/1991 | D'Andrade | D21/147 |
| D. 336,939 | 6/1993 | Salmon et al. | D21/145 |
| D. 338,697 | 8/1993 | Salmon et al. | D21/145 |
| D. 340,750 | 10/1993 | Salmon et al. | D21/145 |
| D. 341,174 | 11/1993 | Salmon et al. | D21/145 |
| D. 341,396 | 11/1993 | Salmon et al. | D21/145 |
| 1,964,345 | 6/1934 | Feller | 222/396 |
| 2,049,194 | 7/1936 | Chapin et al. | 222/400.8 |
| 2,303,510 | 12/1942 | Swebilius | 446/473 X |
| 2,589,977 | 3/1952 | Stelzer | 222/79 |
| 3,197,070 | 7/1965 | Pearl et al. | 222/79 |
| 3,273,553 | 9/1966 | Doyle | 446/473 X |
| 3,578,789 | 5/1971 | Ferri | 222/79 |
| 3,794,789 | 2/1974 | Bynum | 200/82 R X |
| 4,022,350 | 5/1977 | Amron | 222/333 X |
| 4,214,674 | 7/1980 | Jones et al. | 222/79 |
| 4,441,629 | 4/1984 | Mackal | 222/324 |
| 4,591,071 | 5/1986 | Johnson | 222/39 |
| 4,706,848 | 11/1987 | D'Andrade | 222/79 |
| 4,735,239 | 4/1988 | Salmon et al. | 141/25 |
| 4,743,030 | 5/1988 | Auer et al. | 273/349 |
| 4,750,641 | 6/1988 | Hun | 446/473 X |
| 4,757,946 | 7/1988 | Johnson | 239/99 |
| 4,854,480 | 8/1989 | Shindo | 222/79 |
| 5,029,732 | 7/1991 | Wong | 222/79 |
| 5,074,437 | 12/1991 | D'Andrade et al. | 222/79 |
| 5,150,819 | 9/1992 | Johnson et al. | 222/79 |
| 5,155,310 | 10/1992 | Goans | 200/82 R |
| 5,184,755 | 2/1993 | Brovelli | 222/79 |
| 5,184,756 | 2/1993 | Amron | 222/79 |
| 5,229,531 | 7/1993 | Song | 42/58 |
| 5,238,149 | 8/1993 | Johnson et al. | 222/79 |
| 5,244,153 | 9/1993 | Kuhn et al. | 239/587.5 |
| 5,339,987 | 8/1994 | D'Andrade | 222/401 X |
| 5,360,142 | 11/1994 | Stern et al. | 222/79 |

*Primary Examiner*—Joseph Kaufman
*Attorney, Agent, or Firm*—Kennedy & Kennedy

[57] ABSTRACT

A water gun 10 having a storage tank (18), a pressure tank (19) and an electric pump (28) for conveying liquid from the storage tank to the pressure tank. The conveyance of liquid into the pressure tank causes the liquid to be pressurized by air compressed within the pressure tank. A safety switch (42) limits the pressurization of the liquid. The pressurized liquid is released through a nozzle (21) coupled to the pressure tank.

13 Claims, 4 Drawing Sheets

ELECTRIC PUMP TOY WATER GUN

TECHNICAL FIELD

This invention relates to toy water guns, and specifically to water guns having electrically motorized pumps.

BACKGROUND OF THE INVENTION

Water guns which eject a stream of water have been a very popular toy for children. These guns have been designed to eject the stream of water in a number of ways. The most common method of ejecting water has been by a manual pump coupled to the trigger of the gun. The pump is actuated by the mere pressure exerted by one finger of an operator upon the trigger, thus the pump typically cannot generate enough pressure to eject the water a lengthy distance. Additionally, these types of pumps work on the actuation of a compression piston which creates single, short bursts of water. However, many children desire the production of an extended stream of water.

water guns have also been designed with small electric pumps which expel a stream of water from a tube coupled to the pump, as shown in U.S. Pat. Nos. 4,706,848 and 4,743,030. However, these small electric pumps typically cannot eject the stream of water a lengthy distance.

Toy water guns have also been developed which eject a stream of water by exerting pressure on the water within the gun greater than that of ambience and controlling the release of water through a control valve. The water is expelled from the gun due to this pressure difference. The pressurization of the water has been achieved in a variety of manners. U.S. Pat. No. 3,197,070 illustrates a water gun wherein pressure is applied to the water by collapsing a water storage area. Similarly, U.S. Pat. No. 4,854,480 illustrates a water gun wherein water is forced into an elastic bladder which expands to maintain the water under pressure.

Lastly, water guns have been designed with manual pumps which force water or air from a storage reservoir to a pressure reservoir, as shown in U.S. Pat. No. 5,150,819 also jointly invented and owned by the present inventor. The conveyance of the water or air into the pressure tank compresses the air therein, thereby exerting pressure on the water within the storage tank. This type of water gun however is not easily operated by a small child without the strength or stamina to repetitively actuate the manual pumping.

Accordingly, it is seen that a need remains for a water gun which can generate a long, steady stream of water which can be easily operated by a small child. It is to the provision of such therefore that the present invention is primarily directed.

SUMMARY OF THE INVENTION

In a preferred form of the invention a water gun comprises a housing, a storage reservoir adapted to hold liquid and a pressure tank adapted to hold liquid. The water gun also has a pump for drawing liquid from the storage reservoir and depositing the drawn liquid into the pressure tank, an electric motor coupled to the pump, and an electric power supply electrically coupled to the electric motor. Conduit means are included for conveying liquid from the pressure tank to ambience and control means for controlling the flow of liquid therethrough.

DETAILED DESCRIPTION

Figure 1:
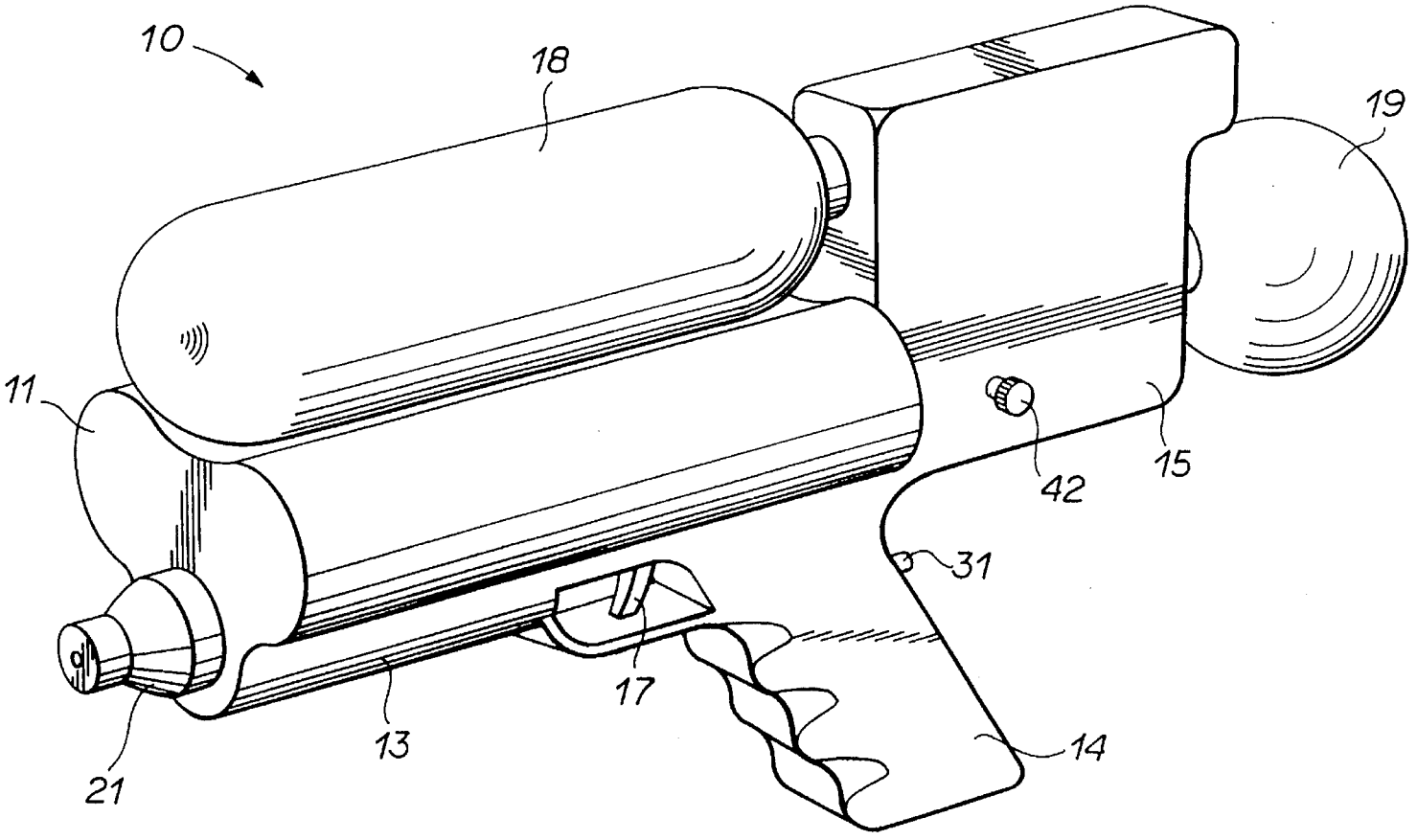
FIG. 1 is a perspective view of a water gun embodying principles of the invention is a preferred form.

With reference next to the drawings, there is shown a water gun 10 having a housing 11 in the shape of a gun with a barrel 13, a handle 14 and a stock 15. The gun 10 has a trigger 17, a removable liquid storage tank or reservoir 18 coupled to the stock 15, a liquid pressure tank 19 coupled to the stock, and a conventional nozzle 21 mounted to the end of the barrel 13 and coupled to trigger 17 by linkage 22. The storage tank 18 has a threaded neck 23 adapted to be threadably mounted within a threaded receptor 24 within the housing. The receptor 24 has a check valve or vent 25 in fluid communication with the storage tank 18.

Figure 2:
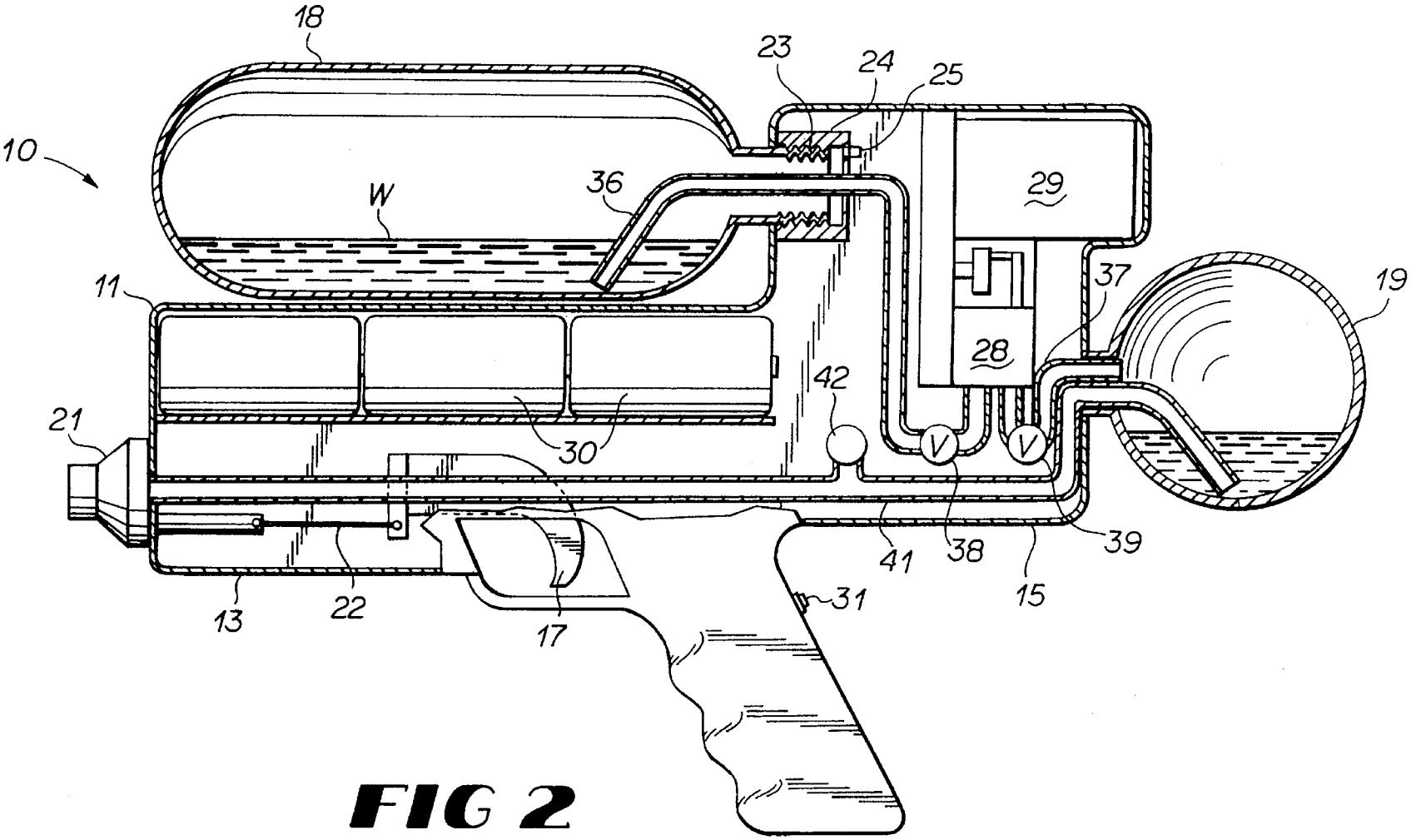
FIG. 2 is a cross-sectional view of the water gun of FIG. 1.
Figure 3:
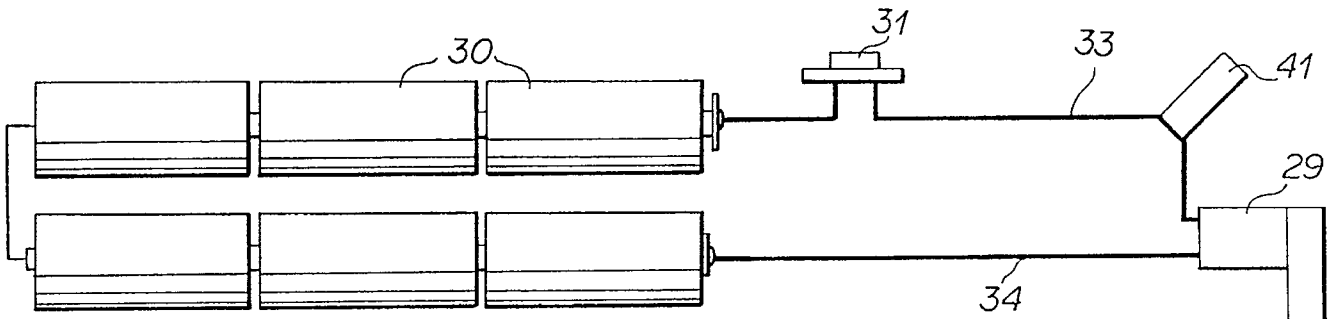
FIG. 3 is a diagram of an electrical control circuit of the water gun of FIG. 1.

As shown in FIGS. 2 and 3, the gun 10 has a liquid pump 28 driven by an electric motor 29 coupled to a series of batteries 30 by conductors 33 and 34 through an on/off switch 31. As shown in FIG. 2, a flexible intake tube 36 extends from the interior of the storage tank 18 to an inlet of pump 28. A flexible outlet tube 37 extends from an outlet of pump 28 to the interior of the pressure tank 19. Intake tube 36 is coupled to a check valve 38 which restricts the flow of liquid to storage tank 18. Similarly, outlet tube 37 is coupled to a check valve 39 which restricts the flow of liquid to pump 28. A flexible delivery tube 41 extends from the pressure tank 19 to nozzle 21. A pressure sensitive safety switch 42 is coupled in fluid communication with the delivery tube 41 and electrically coupled to conductor 33 is series with electric motor 29 and on/off switch 31.

Figure 5:
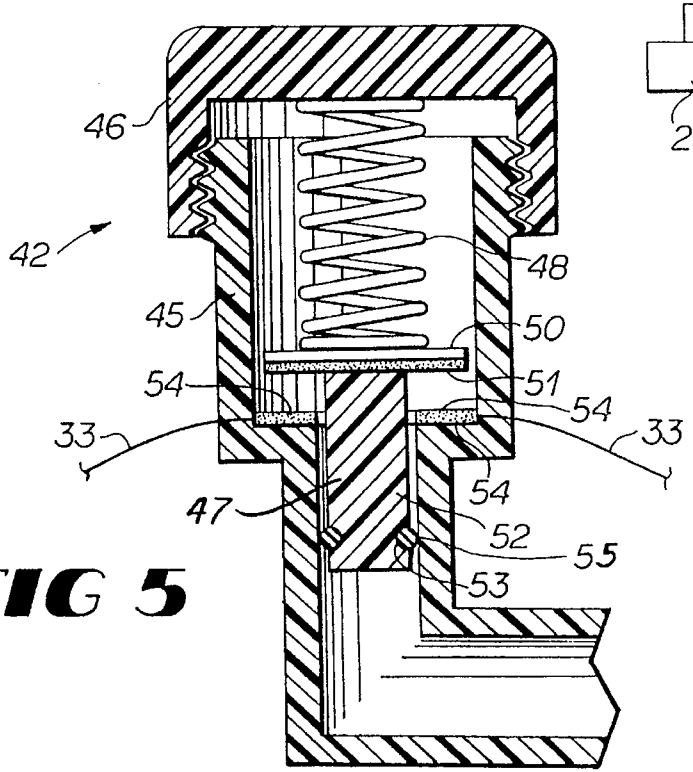
FIG. 5 is a cross-sectional view of a pressure safety switch of the water gun of FIG. 1.

As shown in FIG. 5, the safety switch 42 has a cylindrical housing 45, a cap 46 threadably mounted to the housing 45, a plunger 47 movably mounted within the housing 45 and a spring 48 mounted between the plunger 47 and the cap 46. The plunger 47 has a head portion 50 with an annular conductive bridge 51 and a stem portion 52 depending from the head portion. The stem portion 52 has an annular groove 53 having an O-ring 55 mounted therein which forms a seal between the stem portion 52 and the housing 45. Conductor 33 is coupled to two conductive ends 54 which are mounted to opposite sides of the housing 45 adjacent and contactable with conductive bridge 51.

An operator may set the pressure level at which the safety switch 42 is activated. As best understood by reference to FIG. 5, the safety switch spring 48 biases plunger 47 in a direction to cause the conductive bridge 51 to contact the ends 54 of conductor 33 so as to close the conductive path therebetween and complete the circuit. As the safety switch is also coupled to delivery tube 41 the water pressure therein acts upon plunger stem portion 52 in a direction opposite to that of the biasing force of spring 48. Thus, it should be understood that the threaded movement of the cap 46 upon housing 45 directly corresponds to the water pressure necessary to overcome the biasing force of the spring, i.e. the further the cap is threaded the further compressed the spring 48 becomes and thus the greater the water pressure must be to overcome the spring biasing force to move the plunger conductive bridge 51 out of contact with the conductor ends 54. The threaded position of safety switch cap 46 thus limits the pressure of the water within the gun and thus the pressure of stream of water is emitted.

In use, the liquid storage tank 18 is removed from the stock 15 and filled with a liquid, hereinafter referred to as water W. The storage tank 18 is then threadably remounted to the stock with the intake tube 36 positioned through the neck 23 of the storage tank. The flexibility of the intake tube allows it to come to rest upon the interior floor of the storage tank.

The on-off switch 31 is then moved to its on position to energize the electric motor 29. Activation of the motor drives liquid pump 28 which pumps water from the storage tank 18 to the pressure tank 19 through intake tube 36 and outlet tube 37. Removal of water from the storage tank creates a vacuum within the storage tank which is equalized by air passing through check valve 25. As water is deposited within the pressure tank it displaces a portion of the volume of air therein thus causing the remaining volume of air to be compressed. This compressed air pressurizes the water within pressure tank 19 and delivery tube 41. The pressurized water and compressed air are prevented from escaping the pressure tank through outlet tube 37 by check valve 39. The motorized pump 28 continues to deposit water within the pressure tank 19 until all water is removed from the storage tank or the water pressure reaches the preselected pressure level of the safety switch 42 to cause the opening of circuit and consequential deactivation of the motor. It should be understood that one may also deactivate the motor prior to the activation of the safety switch by simply moving the on/off switch 31 to its off position.

The trigger 17 is then manually pulled to actuate nozzle 21 to an open position whereby the pressurized water within the delivery tube 41 and pressure tank 19 is released as a stream therefrom. Release of the water decreases the water pressure within the pressure tank and delivery tube acting upon safety switch 42. This decrease in pressure causes the plunger 47 to move conductive bridge 51 back into contact with conductor ends 54 so as to complete the circuit and enable the motor 29 to be reenergized. The energization of the motor causes additional water to be pumped from the storage tank 18 to the pressure tank 19 to once again pressurize a volume of water therein. It should also be understood that the water gun may emit a stream of water while simultaneously pumping water from the storage tank to the pressure tank.

Figure 4:
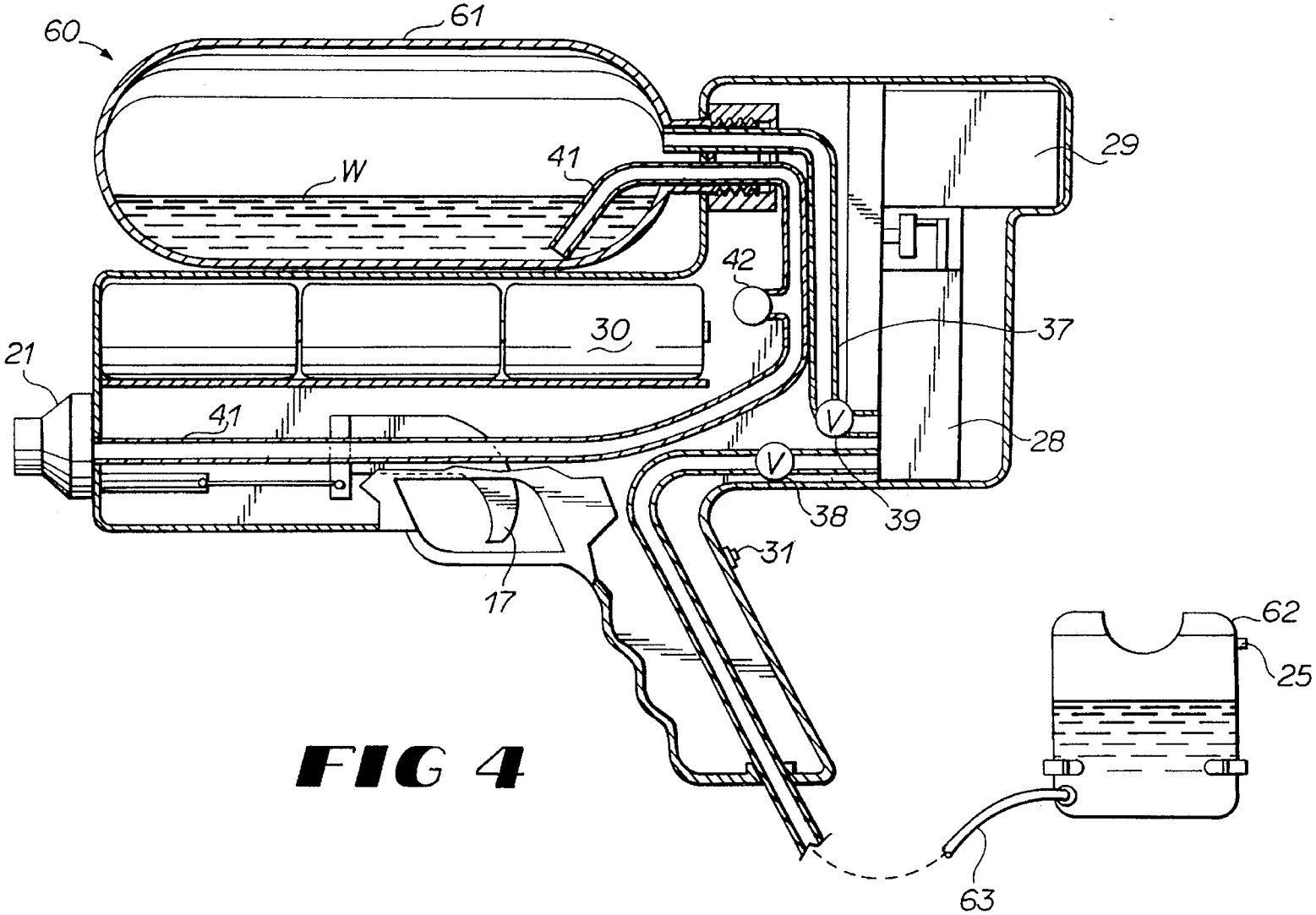
FIG. 4 is a cross-sectional view of a water gun in another preferred form.

With reference next to FIG. 4, a water gun 60 in another preferred form is shown. Here, the water gun 60 is substantially the same as that described in FIGS. 1 and 2 except that the pressure tank 61 is positioned in the location of the storage tank 18 in the previous embodiment and the storage tank 62 is located remotely from the housing of the water gun. The storage tank is coupled to the water gun by an elongated intake tube 63 through which water is conveyed to the pump 28. The remote location of the storage tank substantially lessens the weight of the liquid filled water gun and allows for a greater liquid capacity. The storage tank 62 is shaped as a vest to be worn about the torso of a user.

It thus is seen that a toy water gun in now provided which may be used by a small child without the strength or stamina to operate toy water guns having manual pumps.

While this invention has been described in detail with particular references to the preferred embodiments thereof, it should be understood that many modifications, additions and deletions, in addition to those expressly recited, may be made thereto without departure from the spirit and scope of the invention as set forth in the following claims.

We claim:

1. A portable water gun comprising a housing defining a barrel, a handle and a trigger; a storage reservoir adapted to hold liquid; a pressure tank adapted to hold liquid; a pump for drawing liquid from said storage reservoir and depositing the drawn liquid into said pressure tank; an electric motor coupled with said pump, an electric power supply electrically coupled with said electric motor; conduit means for conveying liquid from said pressure tank to ambience adjacent an end of said barrel; and control means coupled to said trigger for controlling the flow of liquid through said conduit means upon actuation of said trigger.

2. The portable water gun of claim 1 further comprising limiting means for limiting pressure within said pressure tank.

3. The portable water gun of claim 2 wherein said limiting means comprises a pressure sensitive electric switch coupled to said electric motor.

4. The portable water gun of claim 3 wherein said pressure sensitive electric switch is adjustable to vary the pressure at which the switch is actuated.

5. The portable water gun of claim 4 wherein said pressure sensitive electric switch comprises a switch housing, a cap threadably mounted to said switch housing, a movable member movably mounted within said housing, said movable member having a conductive bridge, an electric conductor coupled to said electric motor having ends mounted to said switch housing spatially from each other and contactable with said conductive bridge, a spring mounted between said cap and said movable member for biasing said movable member toward a position wherein said conductive bridge contacts said conductor ends, and second conduit means in fluid communication with said pressure tank so that fluid pressure within said pressure tank forces said movable member in a direction opposite to the direction of force of the spring and whereby the threaded position of the cap varies the compression of the spring to vary the fluid pressure necessary to overcome the spring force to move the conductive bridge from contact with the conductor ends.

6. The portable water gun of claim 1 wherein said storage reservoir comprises a flexible container sized and shaped to be worn as a vest and an elongated tube extending from said container to said housing.

7. The portable water gun of claim 1 further comprising a check valve for preventing water within said pressure tank from returning to said storage reservoir.

8. A portable water gun comprising a housing defining a barrel and a handle;

a trigger;

a liquid storage reservoir;

a liquid pressure tank;

an electrically motorized pump;

an electric power source coupled to said electrically motorized pump;

first conduit means for conveying liquid contained within said storage reservoir to said electrically actuated pump;

second conduit means for conveying liquid from said electrically actuated pump to said pressure tank;

third conduit means for conveying liquid from said pressure tank to ambience; and control means coupled to said trigger for controlling the flow of liquid through said third conduit means upon actuation of said trigger, whereby liquid within the storage reservoir is pumped into the pressure tank through the first and second conduits thereby compressing air within the pressure tank so as to pressurize liquid therein which is controllably released from the pressure tank through the third conduit means by actuation of the trigger controlled control means.

9. The portable water gun of claim 8 further comprising a limiting means for limiting pressure within said pressure tank.

10. The portable water gun of claim 9 wherein said limiting means comprises a pressure sensitive electric switch coupled to said electric motor.

11. The portable water gun of claim 10 wherein said pressure sensitive electric switch is adjustable to vary the pressure at which the switch is actuated.

12. The portable water gun of claim 11 wherein said pressure sensitive electric switch comprises a switch housing, a cap threadably mounted to said switch housing, a movable member movably mounted within said housing, said movable member having a conductive bridge, an electric conductor coupled to said electric motor having ends mounted to said switch housing spatially from each other and contactable with said conductive bridge, a spring mounted between said cap and said movable member for biasing said movable member toward a position wherein said conductive bridge contacts said conductor ends, fourth conduit means in fluid communication with said pressure tank so that fluid pressure within said pressure tank forces said movable member in a direction opposite to the direction of force of the spring and whereby the threaded position of the cap varies the compression of the spring to vary the fluid pressure necessary to overcome the spring force to move the conductive bridge from contact with the conductor ends.

13. The portable water gun of claim 8 further comprising a check valve for preventing water within said pressure tank from returning to said storage reservoir.

* * * * *